US011576005B1

(12) United States Patent
Faundez Hoffmann

(10) Patent No.: US 11,576,005 B1
(45) Date of Patent: Feb. 7, 2023

(54) TIME-VARYING ALWAYS-ON COMPENSATION FOR TONALLY BALANCED 3D-AUDIO RENDERING

(71) Applicant: Meta Platforms Technologies, LLC, Menlo Park, CA (US)

(72) Inventor: Pablo Francisco Faundez Hoffmann, Kenmore, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/389,919

(22) Filed: Jul. 30, 2021

(51) Int. Cl.

| | |
|---|---|
| ***H04S 7/00*** | (2006.01) |
| ***G10L 19/06*** | (2013.01) |
| ***G10L 25/18*** | (2013.01) |
| ***H04R 5/02*** | (2006.01) |
| ***H04R 5/04*** | (2006.01) |
| ***H04S 3/00*** | (2006.01) |

(52) U.S. Cl.
CPC ..... *H04S 7/307* (2013.01); *G10L 19/06* (2013.01); *G10L 25/18* (2013.01); *H04R 5/02* (2013.01); *H04R 5/04* (2013.01); *H04S 3/008* (2013.01); *H04S 2400/01* (2013.01)

(58) Field of Classification Search
None
See application file for complete search history.

(56) References Cited

U.S. PATENT DOCUMENTS

| | | | | |
|---|---|---|---|---|
| 2005/0213779 | A1* | 9/2005 | Coats | H03G 5/10 381/119 |
| 2006/0182290 | A1* | 8/2006 | Yano | H03H 17/0213 381/101 |
| 2008/0159563 | A1* | 7/2008 | Moon | H04S 7/307 381/99 |
| 2015/0350802 | A1* | 12/2015 | Jo | H04S 3/008 381/1 |
| 2017/0034639 | A1* | 2/2017 | Chon | H04S 3/002 |
| 2018/0007483 | A1* | 1/2018 | Chon | H04S 5/005 |
| 2018/0359586 | A1* | 12/2018 | Chon | H04S 5/005 |

* cited by examiner

*Primary Examiner* — Qin Zhu
(74) *Attorney, Agent, or Firm* — Fenwick & West LLP

(57) ABSTRACT

A system reduces sound coloration caused by rendering of a 3D audio signal. The system renders the 3D audio signal including a plurality of channels using the input audio signal. Input spectra data defining spectral information of the input audio signal is computed. 3D spectra data defining spectral information of a single channel representation of the 3D audio signal is computed. The system generates a tonal balance filter based on the input spectral data and the 3D spectral data. The tonal balance filter, when applied to the 3D audio signal, reduces sound coloration caused by the rendering of the 3D audio signal. The tonal balance filter is applied to the 3D audio signal to generate an output audio signal and the output audio signal is presented via a speaker array.

20 Claims, 7 Drawing Sheets

TIME-VARYING ALWAYS-ON COMPENSATION FOR TONALLY BALANCED 3D-AUDIO RENDERING

FIELD OF THE INVENTION

This disclosure relates generally to 3-dimensional (3D) audio rendering, and more specifically to reducing sound coloration for 3D audio rendering.

BACKGROUND 3D audio systems typically suffer from sound coloration, which may be defined as a negative perceptual audio experience elicited by spectral distortion introduced by the 3D audio system that are audible but cannot be associated to 3D sound cues. It is desirable to reduce sound coloration while preserving the spectral information of the original audio content.

SUMMARY

Embodiments relate to reducing sound coloration caused rendering of a 3D audio signal from an input audio signal. Some embodiments include a method performed by one or more processors. The method includes rendering a 3D audio signal including a plurality of channels using an input audio signal. Input spectra data defining spectral information of the input audio signal is computed. 3D spectra data defining spectral information of a single channel representation of the 3D audio signal is computed. The method further includes generating a tonal balance filter based on the input spectral data and the 3D spectral data. The tonal balance filter, when applied to the 3D audio signal, reduces sound coloration caused by the rendering of the 3D audio signal. The method further includes applying the tonal balance filter the 3D audio signal to generate an output audio signal and presenting, via a speaker array, the output audio signal.

Some embodiments include a device. The device includes a speaker array, one or more processors, and a memory. The memory stores program code, when executed by the one or more processors, configures the one or more processors for: rendering a 3D audio signal including a plurality of channels using an input audio signal; computing input spectral data defining spectral information of the input audio signal; computing a 3D spectral data defining spectral information of a single channel representation of the 3D audio signal; generating a tonal balance filter based on the input spectral data and the 3D spectral data, the tonal balance filter configured to, when applied to the 3D audio signal, reduce sound coloration caused by the rendering of the 3D audio signal; applying the tonal balance filter to the 3D audio signal to generate an output audio signal; and presenting, via the speaker array, the output audio signal.

Some embodiments include a non-transitory computer-readable medium including stored program code that, when executed by one or more processors of an audio system, configures the audio system to: render a 3D audio signal including a plurality of channels using an input audio signal; compute input spectral data defining spectral information of the input audio signal; compute a 3D spectral data defining spectral information of a single channel representation of the 3D audio signal; generate a tonal balance filter based on the input spectral data and the 3D spectral data, the tonal balance filter configured to, when applied to the 3D audio signal, reduce sound coloration caused by the rendering of the 3D audio signal; apply the tonal balance filter to the 3D audio signal to generate an output audio signal; and present, via a speaker array, the output audio signal.

Figure 1A:
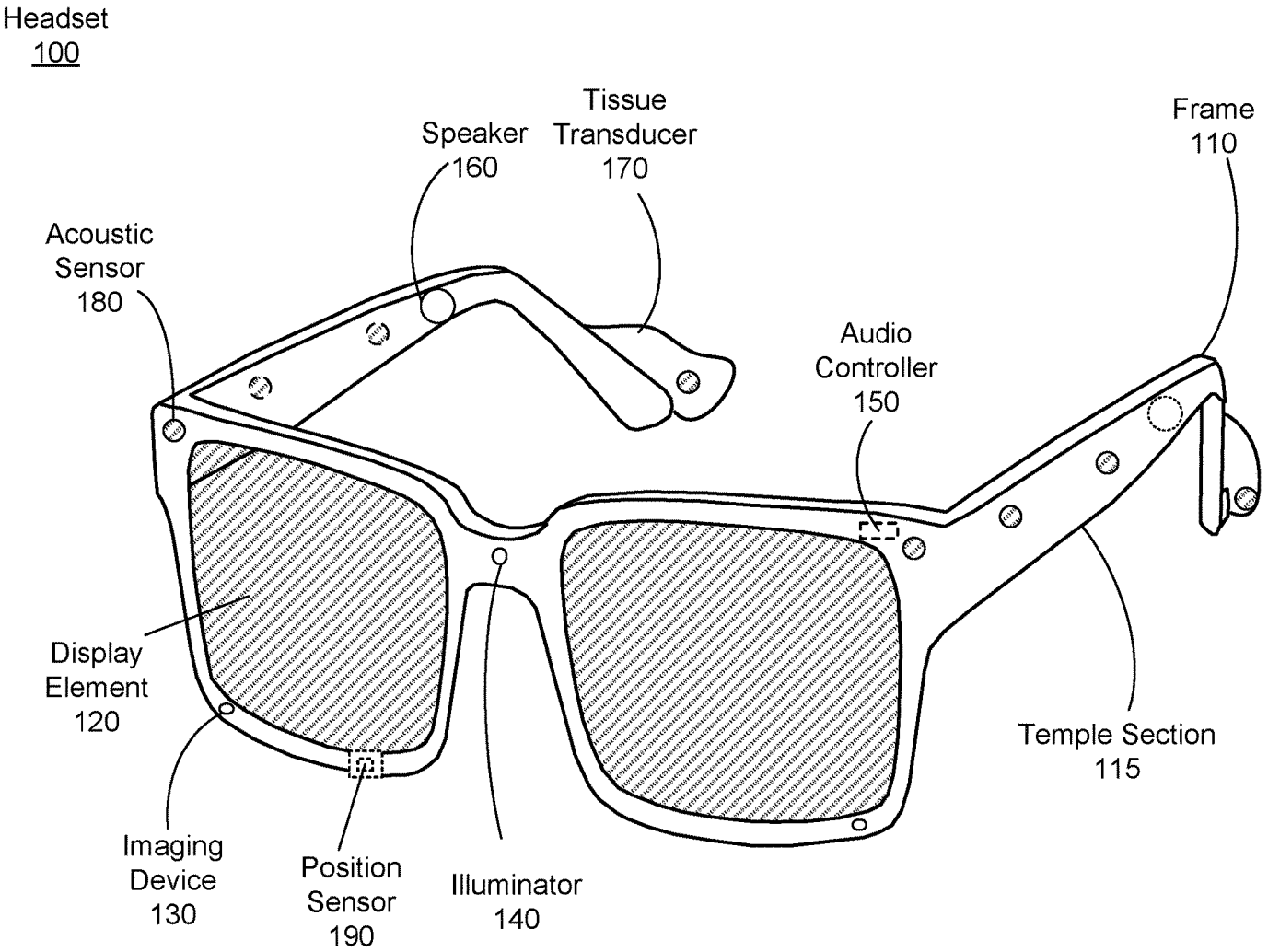
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Embodiments relate to reducing sound coloration caused by rendering of a 3D audio signal from an input audio signal. Generic and pseudo-personalized 3D-audio systems can suffer from sound coloration. Sound coloration refers to a negative perceptual audio experience elicited by spectral distortion introduced by 3D audio rendering that are audible but cannot be associated to 3D-sound cues. Fixed equalization filters have been used to reduce sound coloration but are sub-optimal. These fixed equalization filters include free-field equalizers and diffuse-field equalizers. Free field equalization filters compensate for the effect of a single direction, typically the front direction. Diffuse field equalization filters compensate for the effect of all possible directions. Since the sound coloration introduced by 3D audio rendering often originates from the simultaneous contribution of multiple directions, free-field equalization (single direction) and diffuse-field equalization (all possible directions) may be considered as the extremes of a continuum in the equalization space, which is not always optimal.

Embodiments relate to monitoring the sound coloration introduced by a 3D audio rendering of an input audio signal and correcting the sound coloration with regards to the spectral information that exists at the input audio signal. A 3D audio signal including multiple channels is rendered using an input audio signal. The input audio signal may include one or more channels. To reduce sound coloration caused by the rendering of the 3D audio signal, the difference between the spectral data of the 3D audio signal and the spectral data of the input audio signal are used to generate a tonal balance filter that is applied to the 3D audio signal. For example, input spectral data defining spectral data of a single channel representation of the input audio signal is computed. 3D spectral data defining spectral data of a single channel representation of the 3D audio signal is computed. The tonal balance filter is generated based on the input spectral data and the 3D spectral data, and the tonal balance filter is applied to each channel of the 3D audio signal to generate an output audio signal. The generation of the tonal balance filter may be performed in the time-domain or the frequency-domain. In some embodiments, a sound coloration model can be used to modify the tonal balance filter. The sound coloration model is used to inform the equalization procedure on the sufficient amount of correction required to reduce over-equalization or under-equalization based on perceptual considerations.

The sound coloration reduction discussed herein removes sound coloration while preserving the spectral information of the original audio material. It provides equalization (and in some cases optimal equalization) for the coloration introduced by the 3D-audio renderer at any given time, allowing for equalizations that lie somewhere in between free-field (or any single-direction based equalization) and diffuse field.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

In some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to user. The transducer array includes a plurality of transducers. A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate sound. The number and/or locations of transducers may be different from what is shown in FIG. 1A.

The sensor array detects sounds within the local area of the headset 100. The sensor array includes a plurality of acoustic sensors 180. An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 provides for 3D audio rendering for an input audio signal. The audio controller 150 may comprise one or more processors and a computer-readable storage medium. The computer-readable storage medium includes instructions that, when executed by the one or more processors, configures the one or more processors to perform the functionality discussed herein by the audio controller 150. In some embodiments, the audio controller 150 may include an application specific integrated circuit (ASIC), a field programmable gate array (FPGA), or some other type of processing circuitry.

The audio controller 150 receives the input audio signal and renders a 3D audio signal using the input audio signal. The input audio signal may be a single channel or multiple channels. The 3D audio signal includes multiple channels and provides 3D-sound cues when rendered by the transducer array. The audio controller 150 uses a tonal balance filter to reduce sound coloration caused by the 3D audio rendering. The 3D audio rendering and tonal balance filtering may be performed in the time or frequency domains. The audio controller 150 may use a time-varying algorithm for always-on compensation of the sound coloration.

For example, the audio controller 150 computes input spectral data defining spectral information of the input audio signal. The audio controller 150 also computes 3D spectral data defining spectral information of the 3D audio signal. The audio controller 150 generates the tonal balance filter based on the input spectral data and the 3D spectral data. For processing in the time-domain, the input spectral data and 3D spectral data may each be represented by a spectral curve. The tonal balance filter may be generated using a convolution of the spectral curve of the input audio signal and an inverse of the spectral curve of the 3D audio signal. the tonal balance filter, when applied to the 3D audio signal, reduces sound coloration caused by the rendering of the 3D audio signal For processing in the frequency-domain, the input spectral data and 3D spectral data may each be represented by frequency magnitude vectors. The tonal balance filter may be generated using a ratio between the frequency magnitude vectors of the input audio signal and the frequency magnitude vectors of the 3D audio signal.

In some embodiments, the audio controller 150 uses a sound coloration model to inform or modify the tonal balance filter. The sound coloration model may also be used to generate the input spectral data and 3D spectral data.

The audio controller 150 applies the tonal balance filter to the 3D audio signal to generate an output audio signal and provides the output audio signal to a speaker array. The application of the tonal balance filter to the 3D audio signal results in the output audio signal having reduced sound coloration relative to the 3D audio signal. Additional details regarding sound coloration reduction for 3D audio signals are discussed below in connection with FIGS. 2 through 5.

The audio controller 150 processes information from the sensor array that describes sounds detected by the sensor array. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room. Additional details regarding the components of the headset 100 are discussed below in connection with FIG. 6.

Figure 1B:
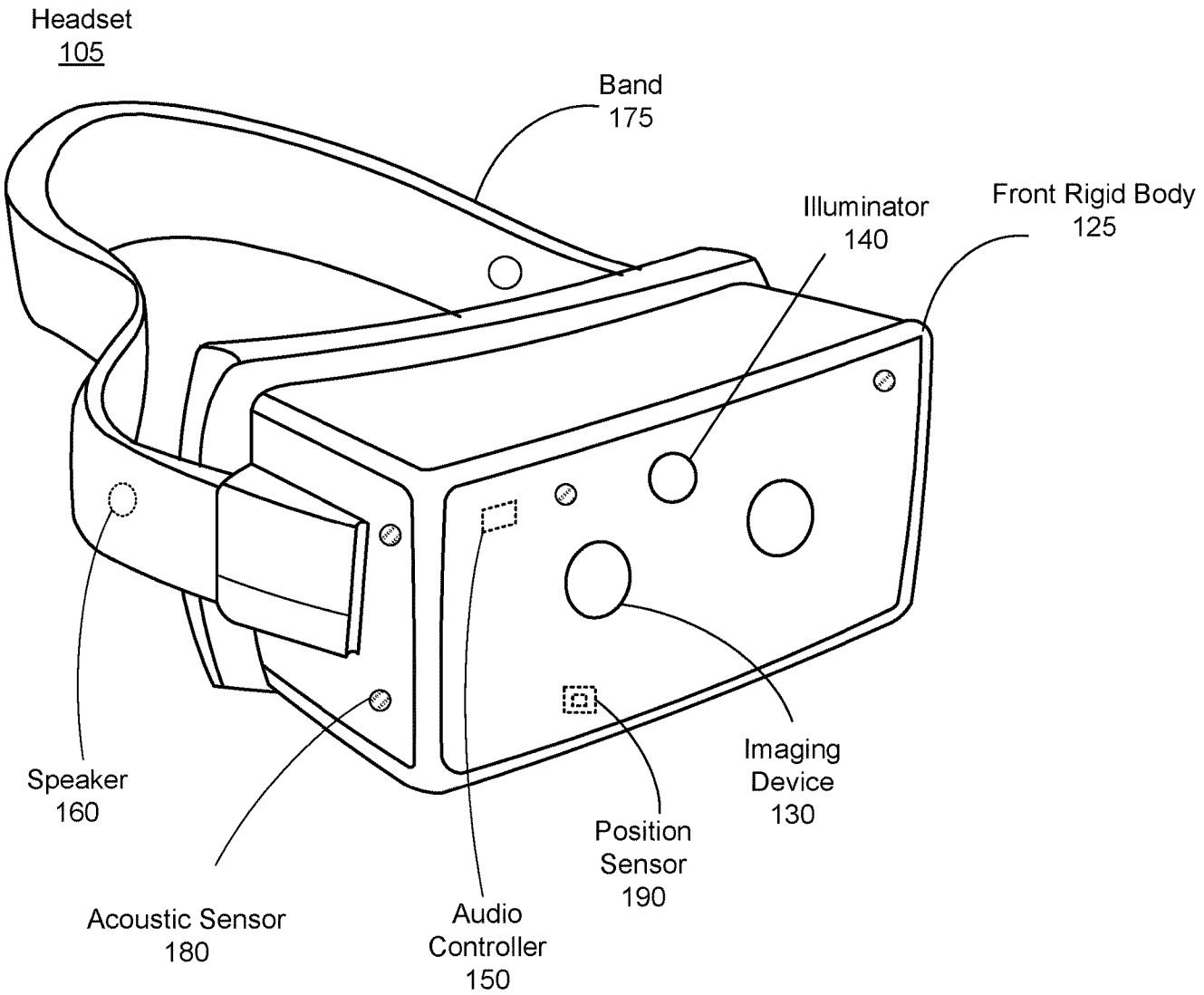
FIG. 1B is a perspective view of a headset implemented as a head-mounted display, in accordance with one or more embodiments.

FIG. 1B is a perspective view of a headset 105 implemented as an HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190. The speakers 160 may be located in various locations, such as coupled to the band 175 (as shown), coupled to front rigid body 115, or may be configured to be inserted within the ear canal of a user.

Figure 2:
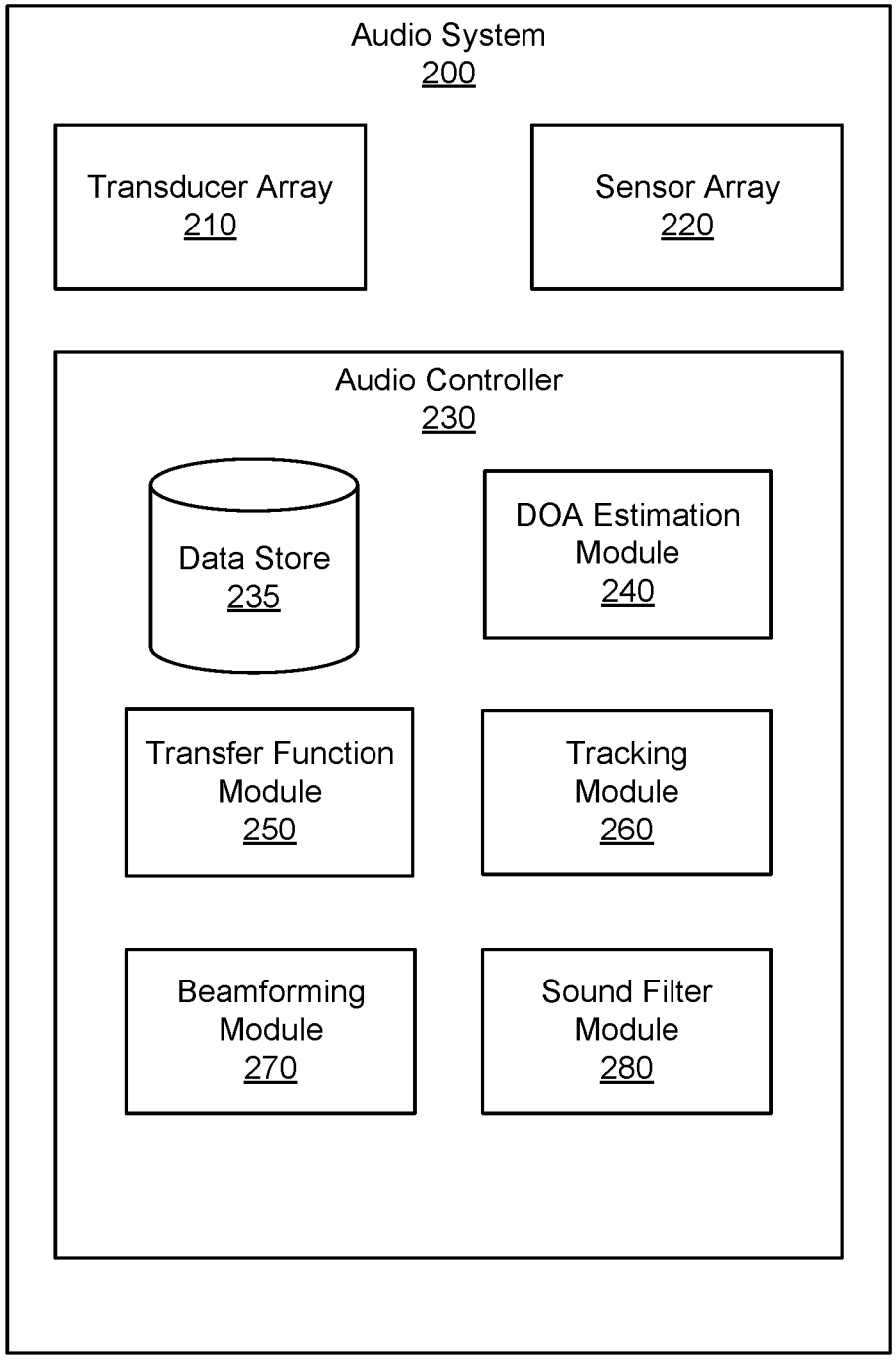
FIG. 2 is a block diagram of an audio system, in accordance with one or more embodiments.

FIG. 2 is a block diagram of an audio system 200, in accordance with one or more embodiments. The audio system in FIG. 1A or FIG. 1B may be an embodiment of the audio system 200. The audio system 200 generates one or more acoustic transfer functions for a user. The audio system 200 may then use the one or more acoustic transfer functions to generate audio content for the user. In the embodiment of FIG. 2, the audio system 200 includes a transducer array 210, a sensor array 220, and an audio controller 230. Some embodiments of the audio system 200 have different components than those described here. Similarly, in some cases, functions can be distributed among the components in a different manner than is described here.

The transducer array 210 is configured to present audio content. The transducer array 210 includes a plurality of transducers. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 210 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 210 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 230, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 210 (also referred to as a speaker array) generates audio content in accordance with instructions from the audio controller 230. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 200. The transducer array 210 may be coupled to a wearable device (e.g., the headset 100 or the headset 105). In alternate embodiments, the transducer array 210 may be a plurality of speakers that are separate from the wearable device (e.g., coupled to an external console).

The sensor array 220 detects sounds within a local area surrounding the sensor array 220. The sensor array 220 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 220 is configured to monitor the audio content generated by the transducer array 210 using at least some of the plurality of acoustic sensors. Increasing the number of sensors may improve the accuracy of information (e.g., directionality) describing a sound field produced by the transducer array 210 and/or sound from the local area.

The audio controller 230 controls operation of the audio system 200. In the embodiment of FIG. 2, the audio controller 230 includes a data store 235, a DOA estimation module 240, a transfer function module 250, a tracking module 260, a beamforming module 270, and a sound filter module 280. The audio controller 230 may be located inside a headset, in some embodiments. Some embodiments of the audio controller 230 have different components than those described here. Similarly, functions can be distributed among the components in different manners than described here. For example, some functions of the controller may be performed external to the headset. The user may opt in to allow the audio controller 230 to transmit data captured by the headset to systems external to the headset, and the user may select privacy settings controlling access to any such data.

The data store 235 stores data for use by the audio system 200. Data in the data store 235 may include sounds recorded in the local area of the audio system 200, audio content such as input audio signals and 3D audio signals, sound coloration models, tonal balance filters, input spectral data, 3D spectral data, output audio data generated using tonal balance filters, head-related transfer functions (HRTFs), transfer functions for one or more sensors, array transfer functions (ATFs) for one or more of the acoustic sensors, sound source locations, virtual model of local area, direction of arrival estimates, sound filters, and other data relevant for use by the audio system 200, or any combination thereof.

The DOA estimation module 240 is configured to localize sound sources in the local area based in part on information from the sensor array 220. Localization is a process of determining where sound sources are located relative to the user of the audio system 200. The DOA estimation module 240 performs a DOA analysis to localize one or more sound sources within the local area. The DOA analysis may include analyzing the intensity, spectra, and/or arrival time of each sound at the sensor array 220 to determine the direction from which the sounds originated. In some cases, the DOA analysis may include any suitable algorithm for analyzing a surrounding acoustic environment in which the audio system 200 is located.

For example, the DOA analysis may be designed to receive input signals from the sensor array 220 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 220 received the direct-path audio signal. The determined angle may then be used to identify the DOA for the received input signal. Other algorithms not listed above may also be used alone or in combination with the above algorithms to determine DOA.

In some embodiments, the DOA estimation module 240 may also determine the DOA with respect to an absolute position of the audio system 200 within the local area. The position of the sensor array 220 may be received from an external system (e.g., some other component of a headset, an artificial reality console, a mapping server, a position sensor (e.g., the position sensor 190), etc.). The external system may create a virtual model of the local area, in which the local area and the position of the audio system 200 are mapped. The received position information may include a location and/or an orientation of some or all of the audio system 200 (e.g., of the sensor array 220). The DOA estimation module 240 may update the estimated DOA based on the received position information.

The transfer function module 250 is configured to generate one or more acoustic transfer functions. Generally, a transfer function is a mathematical function giving a corresponding output value for each possible input value. Based on parameters of the detected sounds, the transfer function module 250 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone receives a sound from a point in space.

An ATF includes a number of transfer functions that characterize a relationship between the sound source and the corresponding sound received by the acoustic sensors in the sensor array 220. Accordingly, for a sound source there is a corresponding transfer function for each of the acoustic sensors in the sensor array 220. And collectively the set of transfer functions is referred to as an ATF. Accordingly, for each sound source there is a corresponding ATF. Note that the sound source may be, e.g., someone or something generating sound in the local area, the user, or one or more transducers of the transducer array 210. The ATF for a particular sound source location relative to the sensor array 220 may differ from user to user due to a person's anatomy (e.g., ear shape, shoulders, etc.) that affects the sound as it travels to the person's ears. Accordingly, the ATFs of the sensor array 220 are personalized for each user of the audio system 200.

In some embodiments, the transfer function module 250 determines one or more HRTFs for a user of the audio system 200. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 250 may determine HRTFs for the user using a calibration process. In some embodiments, the transfer function module 250 may provide information about the user to a remote system. The user may adjust privacy settings to allow or prevent the transfer function module 250 from providing the information about the user to any remote systems. The remote system determines a set of HRTFs that are customized to the user using, e.g., machine learning, and provides the customized set of HRTFs to the audio system 200.

The tracking module 260 is configured to track locations of one or more sound sources. The tracking module 260 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 260 may determine that the sound source moved. In some embodiments, the tracking module 260 may detect a change in location based on visual information received from the headset or some other external source. The tracking module 260 may track the movement of one or more sound sources over time. The tracking module 260 may store values for a number of sound sources and a location of each sound source at each point in time. In response to a change in a value of the number or locations of the sound sources, the tracking module 260 may determine that a sound source moved. The tracking module 260 may calculate an estimate of the localization variance. The localization variance may be used as a confidence level for each determination of a change in movement.

The beamforming module 270 is configured to process one or more ATFs to selectively emphasize sounds from sound sources within a certain area while de-emphasizing sounds from other areas. In analyzing sounds detected by the sensor array 220, the beamforming module 270 may combine information from different acoustic sensors to emphasize sound associated from a particular region of the local area while deemphasizing sound that is from outside of the region. The beamforming module 270 may isolate an audio signal associated with sound from a particular sound source from other sound sources in the local area based on, e.g., different DOA estimates from the DOA estimation module 240 and the tracking module 260. The beamforming module 270 may thus selectively analyze discrete sound sources in the local area. In some embodiments, the beamforming module 270 may enhance a signal from a sound source. For example, the beamforming module 270 may apply sound filters which eliminate signals above, below, or between certain frequencies. Signal enhancement acts to enhance sounds associated with a given identified sound source relative to other sounds detected by the sensor array 220.

The sound filter module 280 provides for 3D audio rendering for input audio signals. The 3D audio signals include multiple channels of audio that produce 3D-sound cues when rendered by the transducer array. The sound filter module 280 uses a tonal balance filter to reduce sound coloration caused by the 3D audio rendering. Additional details regarding the sound filter module 280 are discussed below in connection with FIG. 3.

The sound filter module 280 may also determine sound filters for the transducer array 210. The sound filters cause the audio content to be spatialized, such that the audio content appears to originate from a target region. The sound filter module 280 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 280 calculates one or more of the acoustic parameters. In some embodiments, the sound filter module 280 requests the acoustic parameters from a mapping server (e.g., as described below with regard to FIG. 6).

The sound filter module 280 provides audio content processed using the sound filters to the transducer array 210. In some embodiments, the sound filters may cause positive or negative amplification of sounds as a function of frequency.

Figure 3:
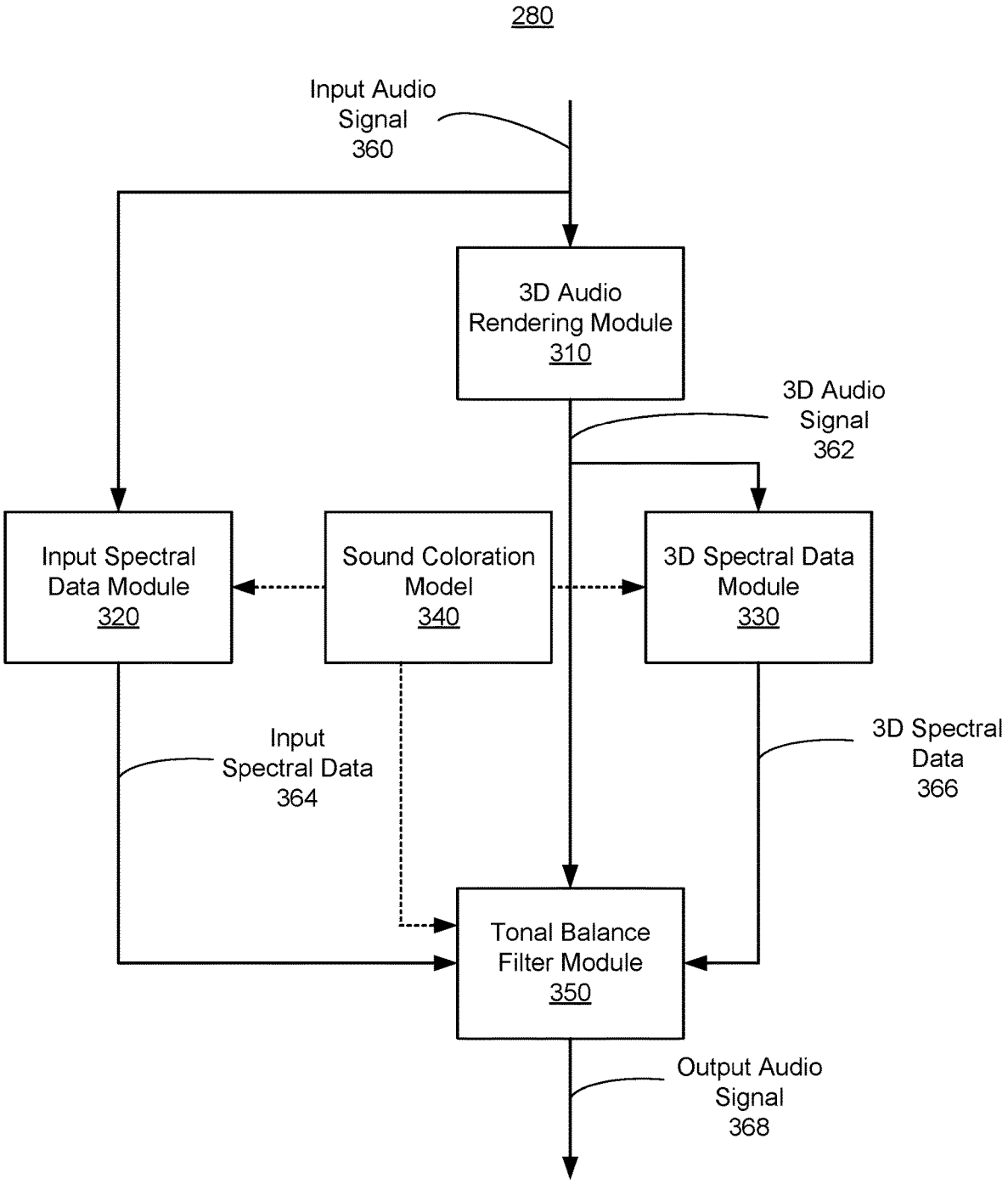
FIG. 3 is a block diagram describing some operations of a sound filter module, in accordance with one or more embodiments.

FIG. 3 is a block diagram describing some operations of a sound filter module 280, in accordance with one or more embodiments. The sound filter module 280 includes a 3D audio rendering module 310, an input spectral data module 320, a 3D spectral data module 330, and a tonal balance filter module 350. Some embodiments of the sound filter module 280 may have different components than those described here. Similarly, in some cases, functions can be distributed among the components in a different manner than is described here.

The 3D audio rendering module 310 generates a 3D audio signal 362 from an input audio signal 360. The input audio signal 360 may include a single audio channel or multiple audio channels. For example, the input audio signal 360 may include a stereo audio signal with left and right channels. In another example, the input audio signal 360 may include a surround sound audio signal with left, right, and one or more peripheral channels. The input audio signal 360 may include audio content captured (e.g., in real-time) by an acoustic sensor 180, stored audio content (e.g., in the data store 235), or some combination thereof. The input audio signal 360 may be for media playback, games, or for communication such as speech signals from single or multiple speakers. The 3D audio rendering module 310 generates the 3D audio signal 362 by methods such as ambisonics, stereo panning, or by applying HRTFs that are generic or specific to a user to the input audio signal 360 to spatialize the input audio signal 360. The 3D audio rendering module 310 may also apply other acoustic parameters, such as reverberation time, reverberation level, room impulse response, etc. The 3D audio rendering by the 3D audio rendering module incorporates spatial cues to the input audio signal. These spatial cues may enable apparent sound source location in azimuth, elevation, and distance. The 3D audio signal 362 may include stereo or multiple channels, with each channel for rendering by a speaker of a speaker array. Multi-channel program may also be downmixed to two channels for stereo playback over speakers or headphones.

The input spectral data module 320 computes input spectral data 364 defining spectral information of the input audio signal 360. The spectral information of an audio signal defines how the energy of the audio signal is distributed as a function of frequency. The input spectral data 364 may be computed using a single channel representation of the input audio signal 360. If the input audio signal 360 includes multiple channels, the input spectral data module 320 may compute a sum across the channels of the input audio signal 360 to generate the single channel representation. The input spectral data 364 is determined using the single channel representation in either the time-domain or frequency-domain, as discussed in greater detail below.

The 3D spectral data module 330 computes 3D spectral data 366 defining spectral information of the 3D audio signal 362. The 3D spectral data 366 may be computed using a single channel representation of the multiple channels of the 3D audio signal 362. For example, the 3D spectral data module 330 may compute a sum across the channels of the 3D audio signal 362. The 3D spectral data 366 is determined using the single channel representation in either the time-domain or frequency-domain, as discussed in greater detail below.

The tonal balance filter module 350 generates a tonal balance filter based on the input spectral data 364 and the 3D spectral data 366. The tonal balance filter module 350 uses a difference between the spectral content represented by the input spectral data 364 and the 3D spectral data 366, which may be compared against the sound coloration model 340, to generate the tonal balance filter such that the tonal balance filter efficiently compensates for this difference.

The tonal balance filter module 350 applies the tonal balance filter to the 3D audio signal 362 to generate the output audio signal 368. For example, the tonal balance filter may be applied to each channel of the 3D audio signal 362 to equalize these channels and increase tonal balance. By applying the same tonal balance filter to all channels, no differences are introduced across channels thus faithfully preserving inter-channel 3D-audio information.

To ensure that silences or low-energy frequency regions in the 3D audio signal 362 generated by the 3D audio rendering module 310 do not create large amplifications, typically greater than 15 or 20 dB, in the output audio signal 368, the frequency-dependent gain of the tonal balance filter may be limited. The limitation may be imposed by choosing a constant threshold across frequency or by choosing a frequency-dependent threshold, more amplification control may be required at low-frequencies than at high frequencies due to power constraints.

The processing by the input spectral data module 320, 3D spectral data module 330 and tonal balance filter module 350 to generate the tonal balance filter may be performed in the time-domain or the frequency-domain. For time-domain processing, the input spectral data 364 generated by the input spectral data module 320 and the 3D spectral data 366 generated by the 3D spectral data module 330 are each represented by a spectral envelope. The spectral envelope of the input spectra data 364 is also referred to as an input spectral envelope and the spectral envelope of the 3D spectral data 366 is also referred to as a 3D spectral envelope. The spectral envelopes may be generated in various ways, such as using linear predictive coding or autoregressive modeling. For autoregressive modeling, an all-pole infinite impulse response (IIR) filter representation of a selected order may be used. To control the amount of detail encoded in the spectral envelopes, the input spectral data module 320 and 3D spectral data module 330 may use the sound coloration model 340 to determine the order of the autoregressive model. The tonal balance filter module 350 generates the tonal balance filter based on a convolution between the input spectral envelope and an inverse of the 3D spectral envelope. The inverse of the 3D spectral envelope represents the inverse of the autoregressive model used by the 3D spectral data module 330. Because the autoregressive model is an all-pole model, its inverse is an all-zero model (or finite impulse response (FIR) filter), thus providing for stability of the tonal balance filter. Once the tonal balance filter is computed in 350, the filter is convolved with the 3D audio signal 362. This process may be implemented as convolution in time domain or complex multiplication in frequency domain. If the filtering is applied in the frequency domain as described below in more detail below, an inverse Fourier Transform is used to generate the 3D audio rendering time-domain signal. If the output of the 3D audio rendering module 310 is multichannel the same tonal balance filter may be equally applied to all channels.

For frequency-domain processing, the input spectral data 364 generated by the input spectral data module 320 and the 3D spectral data 366 generated by the 3D spectral data module 330 are each represented by frequency magnitude vectors. The frequency magnitude vectors of the input spectra data 364 are also referred to as input frequency magnitude vectors and the frequency magnitude vectors of the 3D spectra data 366 are also referred to as 3D frequency magnitude vectors. Each of the input frequency magnitude vectors and 3D frequency magnitude vectors may be computed using a subband processing based on, for example, an analysis filter bank implementation. The level of detail in the frequency magnitude vectors may be controlled by the frequency resolution of the filter bank. The tonal balance filter module 350 generates the tonal balance filter based on a ratio between the input frequency magnitude vectors (e.g., in the numerator) and 3D frequency magnitude vectors (e.g., in the denominator). To generate the output audio signal, the tonal balance filter module 350 multiplies the tonal balance filter with each of the channels of the 3D audio signal. The tonal balance filter module 350 may also convert the output audio signal to the time domain, such as by using a synthesis filter bank to transform the subband output audio signal to a time-domain representation of the output audio signal.

In some embodiments, the tonal balance filter module 350 uses the sound coloration model 340 to inform or modify the tonal balance filter. The sound coloration model 340 may be used with either the time-domain or frequency-domain processing. The sound coloration model 340 provides for perceptually-motivated spectral tuning of the shape of the tonal balance filter. The sound coloration model 340 may be generated based on perceptual metrics such as spectral profile analysis.

In some embodiments, the sound filter module 280 applies a time-varying algorithm for always-on compensation of the sound coloration. The tonal balance filter may be updated over time as defined by an update rate between new and old filter coefficients. Each update of the tonal balance filter may be calculated by analyzing the spectral data within a particular time period. For example, within a time period t1, the sound filter module 280 receives the input audio signal 360 for the time period t1 and stores the input audio signal 360 for the time period t1 within a buffer. The input audio signal 360 for time period t1 is used to render a 3D audio signal 362 for the time period t1, which may also be stored in the buffer. The input spectral data 364 for time period t1 is calculated using the input audio signal 360 for time period t1 and the 3D spectral data 366 for time period t1 is calculated using the 3D audio signal 362 for time period t1. The tonal balance filter module 350 generates the tonal balance filter using the input spectral data 364 for time period t1 and the 3D spectral data 366 for time period t1. The tonal balance filter may be applied to the 3D audio signal 362 for at least a portion of the time period t1, such as the time remaining in time period t1 after creation of the tonal balance filter. While the tonal balance filter is being applied to the 3D audio signal 362 for time period t1, an updated tonal balance filter is determined using the audio signals for a time period t2. The updated tonal balance filter is applied to the 3D audio signal 362 for at least a portion of the time period t2, and so forth. This process may be repeated for multiple time periods to provide the time-varying, always-on compensation of the sound coloration. The length of the time periods may be adjustable and may depend on an adjustable update rate for the tonal balance filter.

Figure 4:
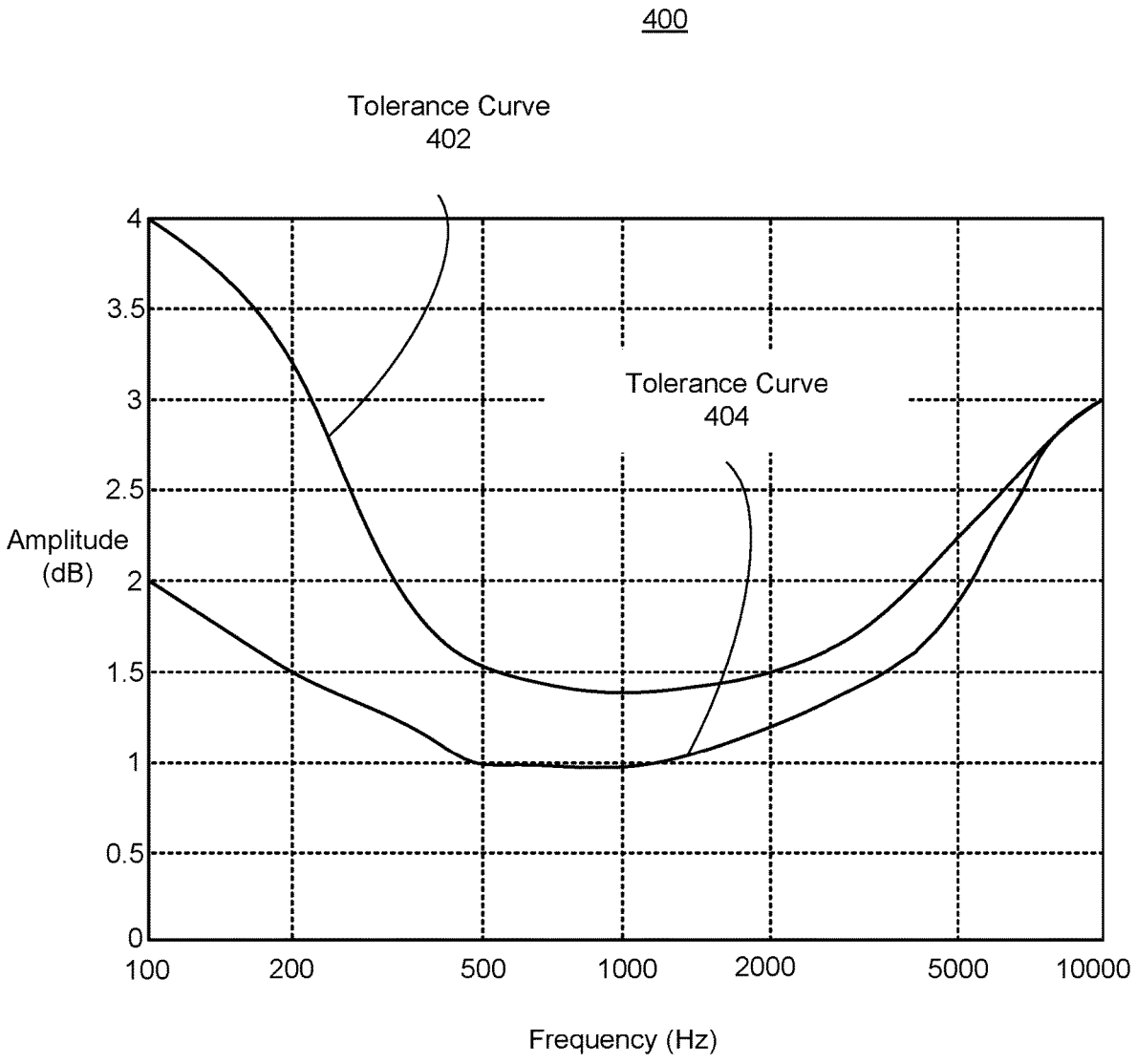
FIG. 4 is a graph of sound coloration models, in accordance with one or more embodiments.

FIG. 4 is a graph 400 of sound coloration models, in accordance with one or more embodiments. The graph 400 shows amplitudes (dB) as a function of frequency (Hz). Tolerance curve 402 is a frequency-dependent tolerance curve from a coloration model based on average coloration sensitivity. Tolerance curve 404 is a frequency-dependent tolerance curve from a coloration model based on high coloration sensitivity. The tolerance curves 402 and 404 are determined based on audibility thresholds at different frequencies. A family of curves may be constructed in between the tolerance curves 402 and 404 to fit different sound coloration control requirements.

The sound coloration model 340 provides frequency-dependent subjective thresholds for the perception of coloration based on profile analysis, i.e. the ability of human subjects to discriminate between spectral shapes. The average-sensitivity tolerance curve 402 and high-sensitivity tolerance curve 404 may be provided by this model. The difference between the input spectral data 364 and 3D spectral data module 366 may be compared against the selected tolerance curve in the sound coloration model 340. For differences that fall below the tolerance curve, no coloration correction may be required, and the tonal balance filter may be built based on differences above the tolerance curve.

Figure 5:
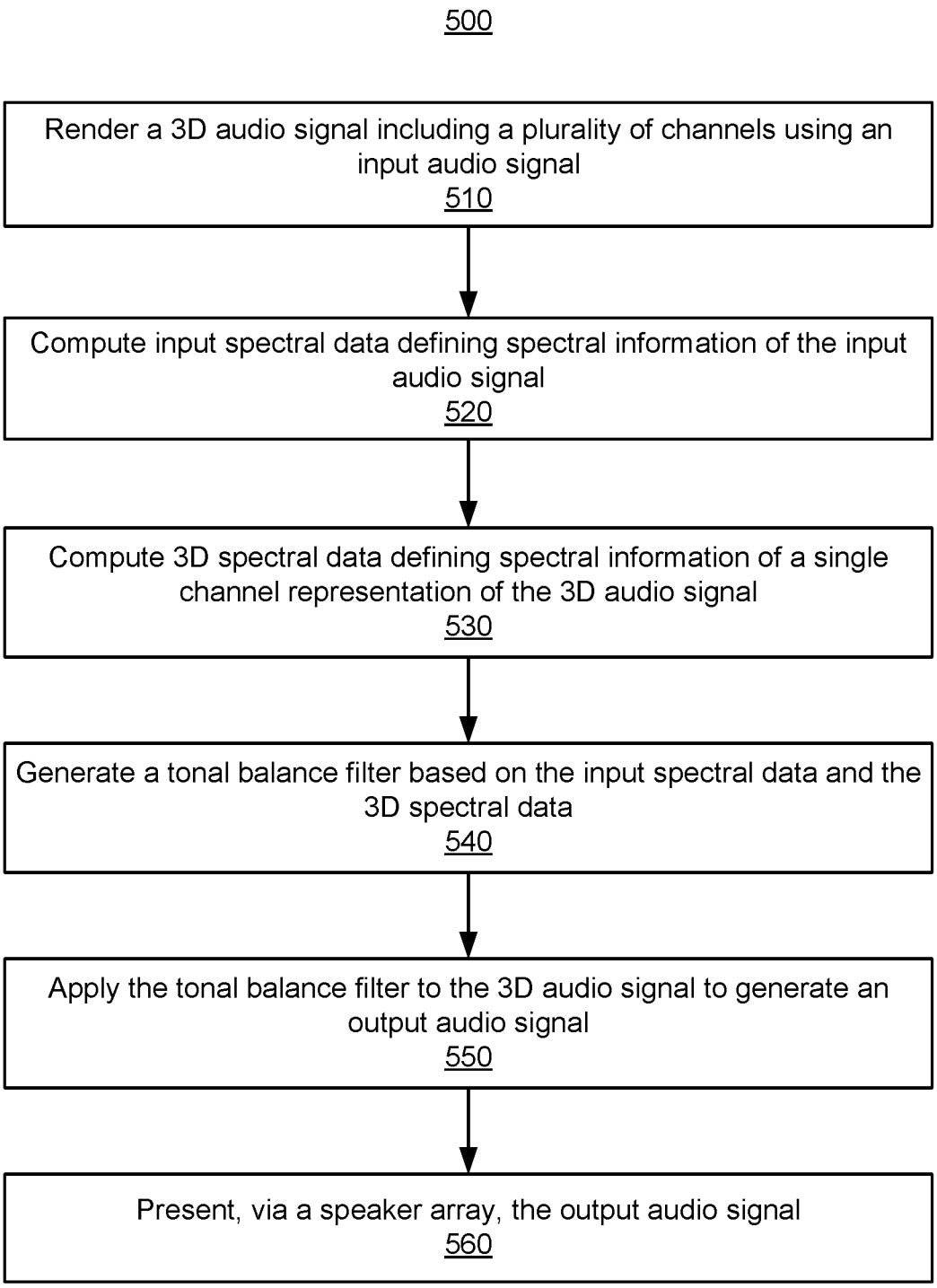
FIG. 5 is a flowchart illustrating an example of a process for reducing sound coloration in a 3D audio signal, in accordance with one or more embodiments.

FIG. 5 is a flowchart illustrating an example of a process 500 for reducing sound coloration in a 3D audio signal, in accordance with one or more embodiments. The process shown in FIG. 5 may be performed by components of an audio system (e.g., audio system 200). Other entities may perform some or all of the steps in FIG. 5 in other embodiments. Embodiments may include different and/or additional steps, or perform the steps in different orders.

The audio system renders 510 a 3D audio signal using an input audio signal. The 3D audio signal includes multiple channels. Rendering the 3D audio signal may include using ambisonics, stereo panning, or HRTFs that are generic or specific to a user to the input audio signal to spatialize the input audio signal.

The audio system computes 520 input spectral data defining spectral information of the input audio signal. The input audio signal may include one or more channels. For multiple channels, a single channel representation of the input audio signal may be generated by summing the channels, and the input spectral data is computed using the single channel representation.

For time-domain processing, the input spectral data is represented by an input spectral curve. The input spectral curve may be computed using an autoregressive model or a linear predictive coding. In some embodiments, a sound coloration model is used to determine an order of the autoregressive model.

For frequency-domain processing, the input spectral data is represented by input frequency magnitude vectors. The input frequency magnitude vectors may be computed using a subband processing, such as based on an analysis filter bank implementation. The level of the detail in the input frequency magnitude vectors may be controlled using a frequency resolution of the analysis filter bank.

The audio system computes 530 3D spectral data defining spectral information of a single channel representation of the 3D audio signal. The single channel representation of the 3D audio signal may be generated by summing the channels. The 3D spectral data may be generated using the same type of processing used to generate the input spectral data.

For time-domain processing, the 3D spectral data is represented by a 3D spectral curve. The 3D spectral curve may be computed using an autoregressive model or a linear predictive coding. In some embodiments, a sound coloration model is used to determine an order of the autoregressive model.

For frequency-domain processing, the 3D spectral data is represented by 3D frequency magnitude vectors. The 3D frequency magnitude vectors may be computed using a subband processing, such as based on an analysis filter bank implementation. The level of the detail in the input frequency magnitude vectors may be controlled using a frequency resolution of the analysis filter bank.

The audio system generates 540 a tonal balance filter based on the input spectral data and the 3D spectral data. When applied to the 3D audio signal, the tonal balance filter reduces or removes the sound coloration introduced by the 3D-audio rendering, while preserving the original spectral content of the input audio signal. In some embodiments, the tonal balance filter is modified using a sound coloration model. For example, the difference between the input spectral data and 3D spectral data may be compared against a selected tolerance curve in the sound coloration model. For differences that fall below the tolerance curve, no coloration correction may be required, and the tonal balance filter may be built based on differences above the tolerance curve.

For time-domain processing, generating the tonal balance filter may include determining a convolution between the input spectral curve and an inverse of the 3D spectral curve. The autoregressive model of the 3D spectral curve is an all-pole model and thus the inverse of the 3D spectral curve includes an all-zero model. This results in stability of the tonal balance filter. For frequency-domain processing, generating the tonal balance filter may include determining a ratio between the input frequency magnitude vectors and the 3D frequency magnitude vectors.

The audio system applies 550 the tonal balance filter to the 3D audio signal to generate an output audio signal. The tonal balance filter may be applied to each channel of the 3D audio signal to generate the output audio signal. Application of the tonal balance filter to the 3D audio signal may be performed in the time-domain or frequency-domain. In the time domain, the tonal balance filter is convolved with the 3D audio signal. In the frequency domain, the tonal balance filter is multiplied with subband representations of the channels of the 3D audio signal to generate subband outputs. The subband outputs are transformed to the time-domain to generate the output audio signal, such as by using a synthesis filter bank.

The audio system presents 560, via a speaker array, the output audio signal. For example, each channel of the output audio signal may be provided to a respective speaker of the speaker array. The speaker array may include two or more speakers. The 3D audio signal and the output audio signal may include two or more channels, each corresponding to one of the speakers of the speaker array. The speaker array may include various types of speakers, including stereo speakers, speakers on a headset (e.g., headset 100 or 105), headphones, loudspeakers, surround sound (e.g., 5.1 audio system) speakers, smart speakers, etc.

Figure 6:
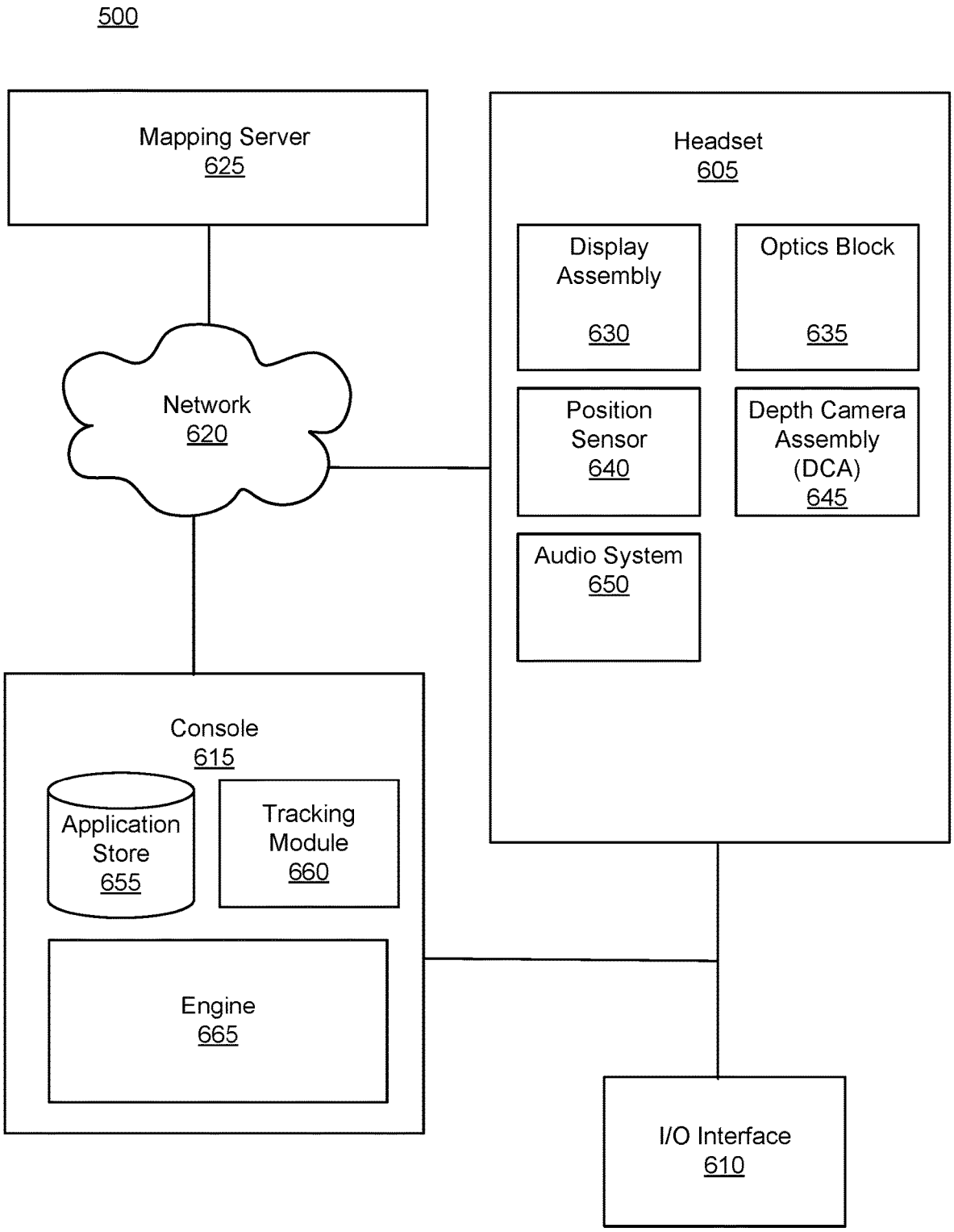
FIG. 6 is a system that includes a headset, in accordance with one or more embodiments.

FIG. 6 is a system 600 that includes a headset 605, in accordance with one or more embodiments. In some embodiments, the headset 605 may be the headset 100 of FIG. 1A or the headset 105 of FIG. 1B. The system 600 may operate in an artificial reality environment (e.g., a virtual reality environment, an augmented reality environment, a mixed reality environment, or some combination thereof). The system 600 shown by FIG. 6 includes the headset 605, an input/output (I/O) interface 610 that is coupled to a console 615, the network 620, and the mapping server 625. While FIG. 6 shows an example system 600 including one headset 605 and one I/O interface 610, in other embodiments any number of these components may be included in the system 600. For example, there may be multiple headsets each having an associated I/O interface 610, with each headset and I/O interface 610 communicating with the console 615. In alternative configurations, different and/or additional components may be included in the system 600. Additionally, functionality described in conjunction with one or more of the components shown in FIG. 6 may be distributed among the components in a different manner than described in conjunction with FIG. 6 in some embodiments. For example, some or all of the functionality of the console 615 may be provided by the headset 605.

The headset 605 includes the display assembly 630, an optics block 635, one or more position sensors 640, and the DCA 645. Some embodiments of headset 605 have different components than those described in conjunction with FIG. 6. Additionally, the functionality provided by various components described in conjunction with FIG. 6 may be differently distributed among the components of the headset 605 in other embodiments, or be captured in separate assemblies remote from the headset 605.

The display assembly 630 displays content to the user in accordance with data received from the console 615. The display assembly 630 displays the content using one or more display elements (e.g., the display elements 120). A display element may be, e.g., an electronic display. In various embodiments, the display assembly 630 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 635.

The optics block 635 may magnify image light received from the electronic display, corrects optical errors associated with the image light, and presents the corrected image light to one or both eyeboxes of the headset 605. In various embodiments, the optics block 635 includes one or more optical elements. Example optical elements included in the optics block 635 include: an aperture, a Fresnel lens, a convex lens, a concave lens, a filter, a reflecting surface, or any other suitable optical element that affects image light. Moreover, the optics block 635 may include combinations of different optical elements. In some embodiments, one or more of the optical elements in the optics block 635 may have one or more coatings, such as partially reflective or anti-reflective coatings.

Magnification and focusing of the image light by the optics block 635 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 635 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 635 corrects the distortion when it receives image light from the electronic display generated based on the content.

The position sensor 640 is an electronic device that generates data indicating a position of the headset 605. The position sensor 640 generates one or more measurement signals in response to motion of the headset 605. The position sensor 190 is an embodiment of the position sensor 640. Examples of a position sensor 640 include: one or more IMUS, one or more accelerometers, one or more gyroscopes, one or more magnetometers, another suitable type of sensor that detects motion, or some combination thereof. The position sensor 640 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 605 from the sampled data. For example, the IMU integrates the measurement signals received from the accelerometers over time to estimate a velocity vector and integrates the velocity vector over time to determine an estimated position of a reference point on the headset 605. The reference point is a point that may be used to describe the position of the headset 605. While the reference point may generally be defined as a point in space, however, in practice the reference point is defined as a point within the headset 605.

The DCA 645 generates depth information for a portion of the local area. The DCA includes one or more imaging devices and a DCA controller. The DCA 645 may also include an illuminator. Operation and structure of the DCA 645 is described above with regard to FIG. 1A.

The audio system 650 provides audio content to a user of the headset 605. The audio system 650 is substantially the same as the audio system 200 describe above. For example, the audio system 650 generates a 3D audio signal from an input audio signal and applies a tonal balance filer to the 3D audio signal to reduce sound coloration caused by the 3D audio rendering. The audio system 650 may comprise one or more acoustic sensors, one or more transducers, and an audio controller. The audio system 650 may provide spatialized audio content to the user. In some embodiments, the audio system 650 may request acoustic parameters from the mapping server 625 over the network 620. The acoustic parameters describe one or more acoustic properties (e.g., room impulse response, a reverberation time, a reverberation level, etc.) of the local area. The audio system 650 may provide information describing at least a portion of the local area from e.g., the DCA 645 and/or location information for the headset 605 from the position sensor 640. The audio system 650 may generate one or more sound filters using one or more of the acoustic parameters received from the mapping server 625, and use the sound filters to provide audio content to the user.

The I/O interface 610 is a device that allows a user to send action requests and receive responses from the console 615. An action request is a request to perform a particular action. For example, an action request may be an instruction to start or end capture of image or video data, or an instruction to perform a particular action within an application. The I/O interface 610 may include one or more input devices. Example input devices include: a keyboard, a mouse, a game controller, or any other suitable device for receiving action requests and communicating the action requests to the console 615. An action request received by the I/O interface 610 is communicated to the console 615, which performs an action corresponding to the action request. In some embodiments, the I/O interface 610 includes an IMU that captures calibration data indicating an estimated position of the I/O interface 610 relative to an initial position of the I/O interface 610. In some embodiments, the I/O interface 610 may provide haptic feedback to the user in accordance with instructions received from the console 615. For example, haptic feedback is provided when an action request is received, or the console 615 communicates instructions to the I/O interface 610 causing the I/O interface 610 to generate haptic feedback when the console 615 performs an action.

The console 615 provides content to the headset 605 for processing in accordance with information received from one or more of: the DCA 645, the headset 605, and the I/O interface 610. In the example shown in FIG. 6, the console 615 includes an application store 655, a tracking module 660, and an engine 665. Some embodiments of the console 615 have different modules or components than those described in conjunction with FIG. 6. Similarly, the functions further described below may be distributed among components of the console 615 in a different manner than described in conjunction with FIG. 6. In some embodiments, the functionality discussed herein with respect to the console 615 may be implemented in the headset 605, or a remote system.

The application store 655 stores one or more applications for execution by the console 615. An application is a group of instructions, that when executed by a processor, generates content for presentation to the user. Content generated by an application may be in response to inputs received from the user via movement of the headset 605 or the I/O interface 610. Examples of applications include: gaming applications, conferencing applications, video playback applications, or other suitable applications.

The tracking module 660 tracks movements of the headset 605 or of the I/O interface 610 using information from the DCA 645, the one or more position sensors 640, or some combination thereof. For example, the tracking module 660 determines a position of a reference point of the headset 605 in a mapping of a local area based on information from the headset 605. The tracking module 660 may also determine positions of an object or virtual object. Additionally, in some embodiments, the tracking module 660 may use portions of data indicating a position of the headset 605 from the position sensor 640 as well as representations of the local area from the DCA 645 to predict a future location of the headset 605. The tracking module 660 provides the estimated or predicted future position of the headset 605 or the I/O interface 610 to the engine 665.

The engine 665 executes applications and receives position information, acceleration information, velocity information, predicted future positions, or some combination thereof, of the headset 605 from the tracking module 660. Based on the received information, the engine 665 determines content to provide to the headset 605 for presentation to the user. For example, if the received information indicates that the user has looked to the left, the engine 665 generates content for the headset 605 that mirrors the user's movement in a virtual local area or in a local area augmenting the local area with additional content. Additionally, the engine 665 performs an action within an application executing on the console 615 in response to an action request received from the I/O interface 610 and provides feedback to the user that the action was performed. The provided feedback may be visual or audible feedback via the headset 605 or haptic feedback via the I/O interface 610.

The network 620 couples the headset 605 and/or the console 615 to the mapping server 625. The network 620 may include any combination of local area and/or wide area networks using both wireless and/or wired communication systems. For example, the network 620 may include the Internet, as well as mobile telephone networks. In one embodiment, the network 620 uses standard communications technologies and/or protocols. Hence, the network 620 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 620 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 620 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 625 may include a database that stores a virtual model describing a plurality of spaces, wherein one location in the virtual model corresponds to a current configuration of a local area of the headset 605. The mapping server 625 receives, from the headset 605 via the network 620, information describing at least a portion of the local area and/or location information for the local area. The user may adjust privacy settings to allow or prevent the headset 605 from transmitting information to the mapping server 625. The mapping server 625 determines, based on the received information and/or location information, a location in the virtual model that is associated with the local area of the headset 605. The mapping server 625 determines (e.g., retrieves) one or more acoustic parameters associated with the local area, based in part on the determined location in the virtual model and any acoustic parameters associated with the determined location. The mapping server 625 may transmit the location of the local area and any values of acoustic parameters associated with the local area to the headset 605.

One or more components of system 600 may contain a privacy module that stores one or more privacy settings for user data elements. The user data elements describe the user or the headset 605. For example, the user data elements may describe a physical characteristic of the user, an action performed by the user, a location of the user of the headset 605, a location of the headset 605, an HRTF for the user, etc. Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list" of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 600 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

ADDITIONAL CONFIGURATION INFORMATION

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method, comprising:

rendering a 3D audio signal including a plurality of channels using an input audio signal;

computing input spectral data defining spectral information of the input audio signal;

computing a 3D spectral data defining spectral information of a single channel representation of the 3D audio signal;

generating a tonal balance filter based on the input spectral data and the 3D spectral data, the tonal balance filter configured to, when applied to the 3D audio signal, reduce sound coloration caused by the rendering of the 3D audio signal;

applying the tonal balance filter to the plurality of channels of the 3D audio signal to generate an output audio signal; and presenting, via a speaker array, the output audio signal.

2. The method of claim 1, wherein:

the input spectral data is computed for a first time period of the input audio signal;

the 3D spectral data is computed for the first time period of the 3D audio signal; and the tonal balance filter is applied to at least a portion of the first time period of the 3D audio signal.

3. The method of claim 2, further comprising:

while the tonal balance filter is applied to the first time period of the 3D audio signal:

computing second input spectral data for a second time period of the input audio signal subsequent to the first time period;

computing second 3D spectral data for the second time period of the 3D audio signal; and generating a second tonal balance filter based on the second input spectral data and the second 3D spectral data; and applying the second tonal balance filter to at least a portion of the second time period of the 3D audio signal.

4. The method of claim 1, wherein a time-domain processing is used to the compute the input spectral data, compute the 3D spectral data, and generate the tonal balance filter.

5. The method of claim 4, wherein:

the input spectral data is represented by an input spectral curve;

the 3D spectral data is represented by a 3D spectral curve; and the input spectral curve and the 3D spectral curve are each computed using an autoregressive model.

6. The method of claim 5, further comprising using a sound coloration model to determine an order of the autoregressive model.

7. The method of claim 5, wherein generating the tonal balance filter includes determining a convolution between the input spectral curve and an inverse of the 3D spectral curve.

8. The method of claim 7, wherein the autoregressive model of the 3D spectral curve is an all-pole model and the inverse of the 3D spectral curve includes an all-zero model.

9. The method of claim 5, wherein computing the input spectral curve and the 3D spectral curve each includes using a linear predictive coding.

10. The method of claim 1, wherein a frequency-domain processing is used to compute the input spectral data, compute the 3D spectral data, and generate the tonal balance filter.

11. The method of claim 10, wherein:

the input spectral data is represented by input frequency magnitude vectors;

the 3D spectral data is represented by 3D frequency magnitude vectors; and the input frequency magnitude vectors and the 3D frequency magnitude vectors are each computed using a subband processing.

12. The method of claim 11, further comprising controlling a level of detail in the input frequency magnitude vectors and the 3D frequency magnitude vectors using a frequency resolution of an analysis filter bank that implements the subband processing.

13. The method of claim 11, wherein generating the tonal balance filter includes determining a ratio between the input frequency magnitude vectors and the 3D frequency magnitude vectors.

14. The method of claim 13, wherein applying the tonal balance filter to the 3D audio signal to generate the output audio signal includes:

multiplying the tonal balance filter with subband representations of each of the plurality of channels of the 3D audio signal to generate subband outputs; and transforming the subband outputs to a time-domain using a synthesis filter bank.

15. The method of claim 1, further comprising modifying the tonal balance filter using a sound coloration model.

16. A device, comprising:

a speaker array;

one or more processors; and a memory storing program code that, when executed by the one or more processors, configures the one or more processors for:

rendering a 3D audio signal including a plurality of channels using an input audio signal;

computing input spectral data defining spectral information of the input audio signal;

computing a 3D spectral data defining spectral information of a single channel representation of the 3D audio signal;

generating a tonal balance filter based on the input spectral data and the 3D spectral data, the tonal balance filter configured to, when applied to the 3D audio signal, reduce sound coloration caused by the rendering of the 3D audio signal;

applying the tonal balance filter to the 3D audio signal to generate an output audio signal; and presenting, via the speaker array, the output audio signal.

17. The device of claim 16, wherein:

a time-domain processing is used to compute the input spectral data, compute the 3D spectral data, and generate the tonal balance filter;

the input spectral data is represented by an input spectral curve;

the 3D spectral data is represented by a 3D spectral curve; and generating the tonal balance filter includes determining a convolution between the input spectral curve and an inverse of the 3D spectral curve.

18. The device of claim 16, wherein:

a frequency-domain processing is used to compute the input spectral data, compute the 3D spectral data, and generate the tonal balance filter;

the input spectral data is represented by input frequency magnitude vectors;

the 3D spectral data is represented by 3D frequency magnitude vectors; and generating the tonal balance filter includes determining a ratio between the input frequency magnitude vectors and the 3D frequency magnitude vectors.

19. A non-transitory computer-readable storage medium comprising stored program code that, when executed by one or more processors of an audio system, causes the audio system to:

render a 3D audio signal including a plurality of channels using an input audio signal;

compute input spectral data defining spectral information of the input audio signal;

compute a 3D spectral data defining spectral information of a single channel representation of the 3D audio signal;

generate a tonal balance filter based on the input spectral data and the 3D spectral data, the tonal balance filter configured to, when applied to the 3D audio signal, reduce sound coloration caused by the rendering of the 3D audio signal;

apply the tonal balance filter to the 3D audio signal to generate an output audio signal; and present, via a speaker array, the output audio signal.

20. The computer readable medium of claim 19, wherein:

one of a time-domain processing or a frequency-domain processing is used to compute the input spectral data, compute the 3D spectral data, and generate the tonal balance filter;

the input spectral data is represented by an input spectral curve for the time-domain processing or input frequency magnitude vectors for the frequency-domain processing; and the 3D spectral data is represented by a 3D spectral curve for the time-domain processing and 3D frequency magnitude vectors for the frequency-domain processing.

* * * * *